US009790898B2

(12) United States Patent
Dudar

(10) Patent No.: US 9,790,898 B2
(45) Date of Patent: Oct. 17, 2017

(54) SYSTEMS AND METHODS FOR DETERMINING FUEL VAPOR CANISTER CAPACITY

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 183 days.

(21) Appl. No.: 14/700,641

(22) Filed: Apr. 30, 2015

(65) Prior Publication Data

US 2016/0319775 A1 Nov. 3, 2016

(51) Int. Cl.
*F02M 25/08* (2006.01)

(52) U.S. Cl.
CPC .... *F02M 25/0836* (2013.01); *F02M 25/0854* (2013.01)

(58) Field of Classification Search
CPC ..... F02M 25/0836; F02M 25/0854
See application file for complete search history.

(56) References Cited

U.S. PATENT DOCUMENTS 5,128,826 A * 7/1992 Yoneshige ..... H01H 47/04 251/129.09
5,263,462 A * 11/1993 Reddy ..... F02M 25/0809 123/198 D
5,383,437 A * 1/1995 Cook ..... F02M 25/0809 123/198 D
5,727,532 A * 3/1998 Everingham ..... F02M 25/0836 123/458
5,829,416 A * 11/1998 Teraoka ..... F02M 25/0809 123/520
5,890,474 A * 4/1999 Schnaibel ..... F02M 25/0818 123/198 D
6,182,693 B1 2/2001 Stack et al.
6,205,982 B1 * 3/2001 Blomquist ..... F02D 41/004 123/357
6,722,348 B2 * 4/2004 Nagasaki ..... F02M 25/0818 123/198 D
6,874,483 B2 4/2005 Zuchara
6,971,375 B2 * 12/2005 Amano ..... F02M 25/0809 123/494
7,051,718 B2 * 5/2006 Tsuruta ..... F02M 25/0818 123/198 D
7,124,749 B2 * 10/2006 Ohhashi ..... G01M 3/025 123/198 D (Continued)

OTHER PUBLICATIONS

Anonymous, "A Carbon Canister Integrity Diagnostic for HEV Using ELCM Pump," IPCOM No. 000238913, Published Sep. 24, 2014, 2 pages.

*Primary Examiner* — Joseph Dallo
(74) *Attorney, Agent, or Firm* — James Dottavio; McCoy Russell LLP

(57) ABSTRACT

A fuel system is provided, comprising a solenoid valve positioned to regulate flow of fuel vapor between a fuel tank and a fuel vapor canister. The solenoid valve may include an indicator of changes in fuel vapor canister temperature resulting from fuel vapor adsorbing to adsorbent material within the fuel vapor canister and from fuel vapor desorbing from the adsorbent material. In this way, a working capacity of the fuel vapor canister may be determined during refueling and purge events.

20 Claims, 8 Drawing Sheets

(56) References Cited

U.S. PATENT DOCUMENTS

| | | | | |
|---|---|---|---|---|
| 7,284,530 | B2 * | 10/2007 | Nagasaki | F02M 25/0818 123/198 D |
| 7,426,919 | B2 * | 9/2008 | Kano | F02D 41/0045 123/198 D |
| 7,441,549 | B2 * | 10/2008 | Takayanagi | F02M 25/0818 123/520 |
| 7,469,686 | B2 * | 12/2008 | Kano | F02M 25/0809 123/198 D |
| 7,975,675 | B2 * | 7/2011 | Menke | B60K 1/04 123/519 |
| 8,099,999 | B2 | 1/2012 | Nakano | |
| 8,560,167 | B2 * | 10/2013 | Jentz | G01M 3/025 180/441 |
| 8,602,003 | B2 * | 12/2013 | Schoenfuss | F02M 25/0818 123/516 |
| 9,046,060 | B2 * | 6/2015 | Takagi | F02M 25/08 |
| 9,097,216 | B2 * | 8/2015 | Itoh | F02M 25/0854 |
| 9,181,906 | B2 * | 11/2015 | Takamatsu | F02D 41/0032 |
| 2003/0074958 | A1 * | 4/2003 | Nagasaki | F02M 25/0818 73/114.41 |
| 2007/0256670 | A1 | 11/2007 | Williams | |
| 2014/0324284 | A1 | 10/2014 | Glinsky et al. | |

* cited by examiner

SYSTEMS AND METHODS FOR DETERMINING FUEL VAPOR CANISTER CAPACITY

FIELD

The present description relates generally to methods and systems for controlling a vehicle engine to determine loading and unloading of a fuel vapor canister.

BACKGROUND/SUMMARY

Vehicle emission control systems may be configured to store fuel vapors from fuel tank refueling and diurnal engine operations, and then purge the stored vapors during a subsequent engine operation. The fuel vapors may be stored in a fuel vapor canister coupled to the fuel tank which contains adsorbent material, such as activated carbon, capable of adsorbing hydrocarbon fuel vapor.

As the canister ages, the capacity of the adsorbent material to bind and release fuel vapor decreases. This may lead to an increase in emissions if the canister saturates with a reduced amount of fuel vapor. For example, during a refueling event, fuel vapor expected to be adsorbed into the canister may instead be vented to atmosphere. Some regions of the canister may see reduced purge air flow during purge events. Those regions may develop into a canister "heel" where the adsorbent is relatively saturated, and thus does not adsorb or desorb significant quantities of fuel vapor. This may lead to a scenario where the canister is saturated, and the purge event results in less fuel vapor being routed to the engine intake than expected.

In order to verify or diagnose the integrity of a fuel vapor canister, a canister working capacity diagnostic may be used to discern and quantify the ability of the fuel vapor canister to adsorb and desorb hydrocarbons. In this way, increased hydrocarbon emissions due to canister aging can be mitigated by servicing or replacing the fuel vapor canister. Other attempts have been made to determine fuel vapor canister working capacity. One example approach is shown by Glinsky et al. in U.S. Patent Application 2014/0324284. Therein, a dedicated temperature sensor is used to measure fuel vapor canister temperature, and the temperature readings used to determine a sorption capacity of the adsorbent. However, the inventors herein have recognized potential issues with such systems. Adding a separate canister temperature sensor increases manufacturing costs and canister complexity, and requires additional diagnostic routines to ensure that the temperature sensor is functional.

In one example, the issues described above may be addressed by a fuel system, comprising a solenoid valve positioned to regulate flow of fuel vapor between a fuel tank and a fuel vapor canister. The solenoid valve may include an indicator of changes in fuel vapor canister temperature resulting from fuel vapor adsorbing to adsorbent material within the fuel vapor canister. For example, the solenoid valve may be positioned such that changes in canister temperature are transmitted to a solenoid coil of the solenoid valve. The changes in temperature of the solenoid coil may be monitored at a controller, as the internal resistance of the solenoid coil varies based on temperature. In this way, the amount of fuel vapor adsorbing to or desorbing from the fuel vapor canister may be indicated without adding a dedicated temperature sensor to the fuel vapor canister.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
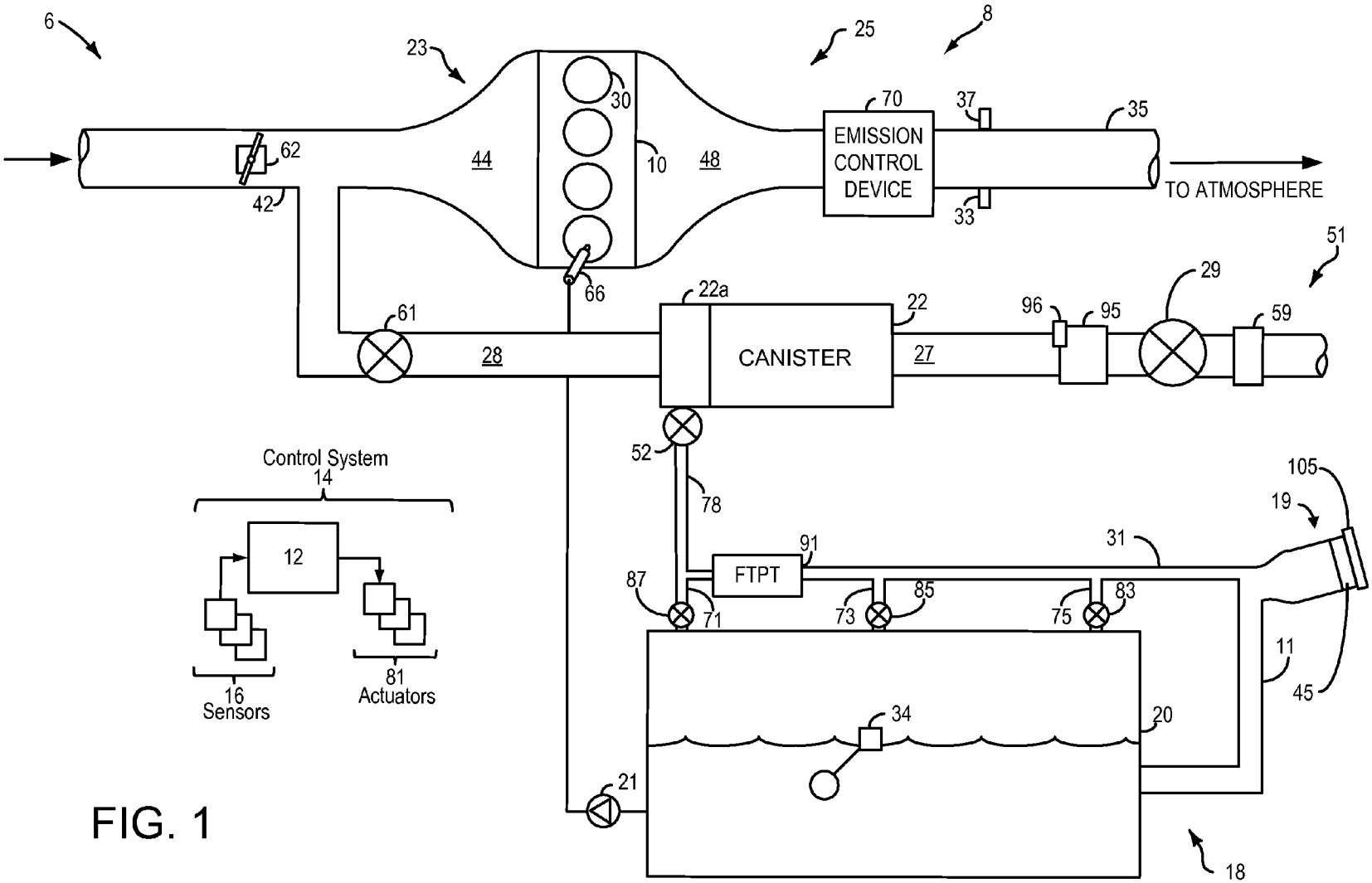
FIG. 1 schematically shows an example vehicle system with a fuel system and an evaporative emissions system.
Figure 2A:
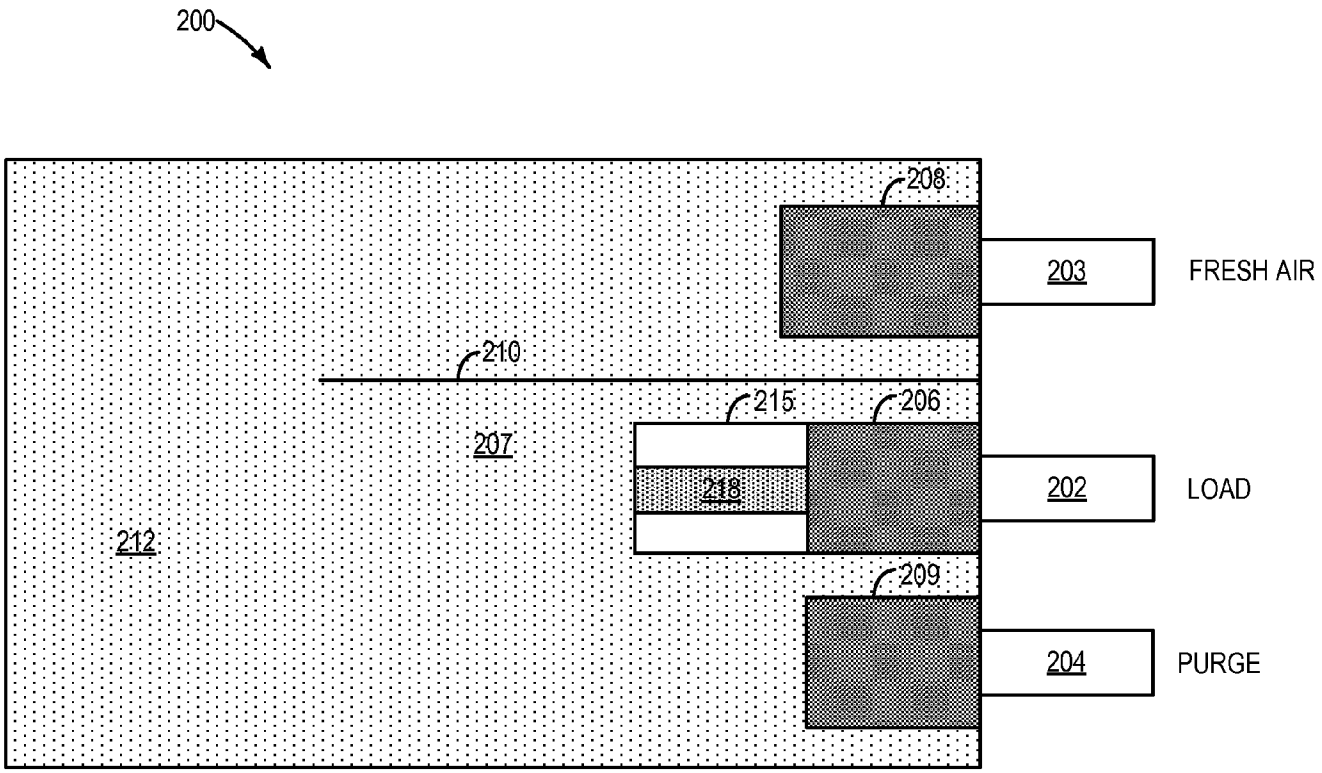
FIG. 2A schematically shows an example fuel vapor canister comprising an internal vapor blocking valve.
Figure 2B:
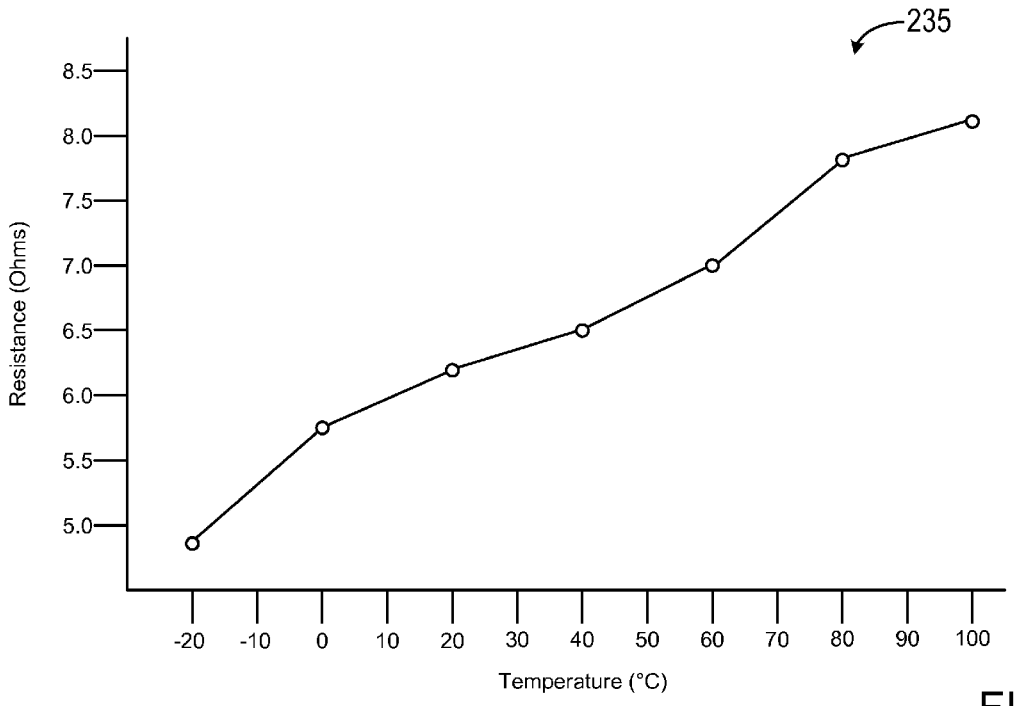
FIG. 2B depicts an example plot showing the relationship between the resistance and temperature of a solenoid valve coil.
Figure 2C:
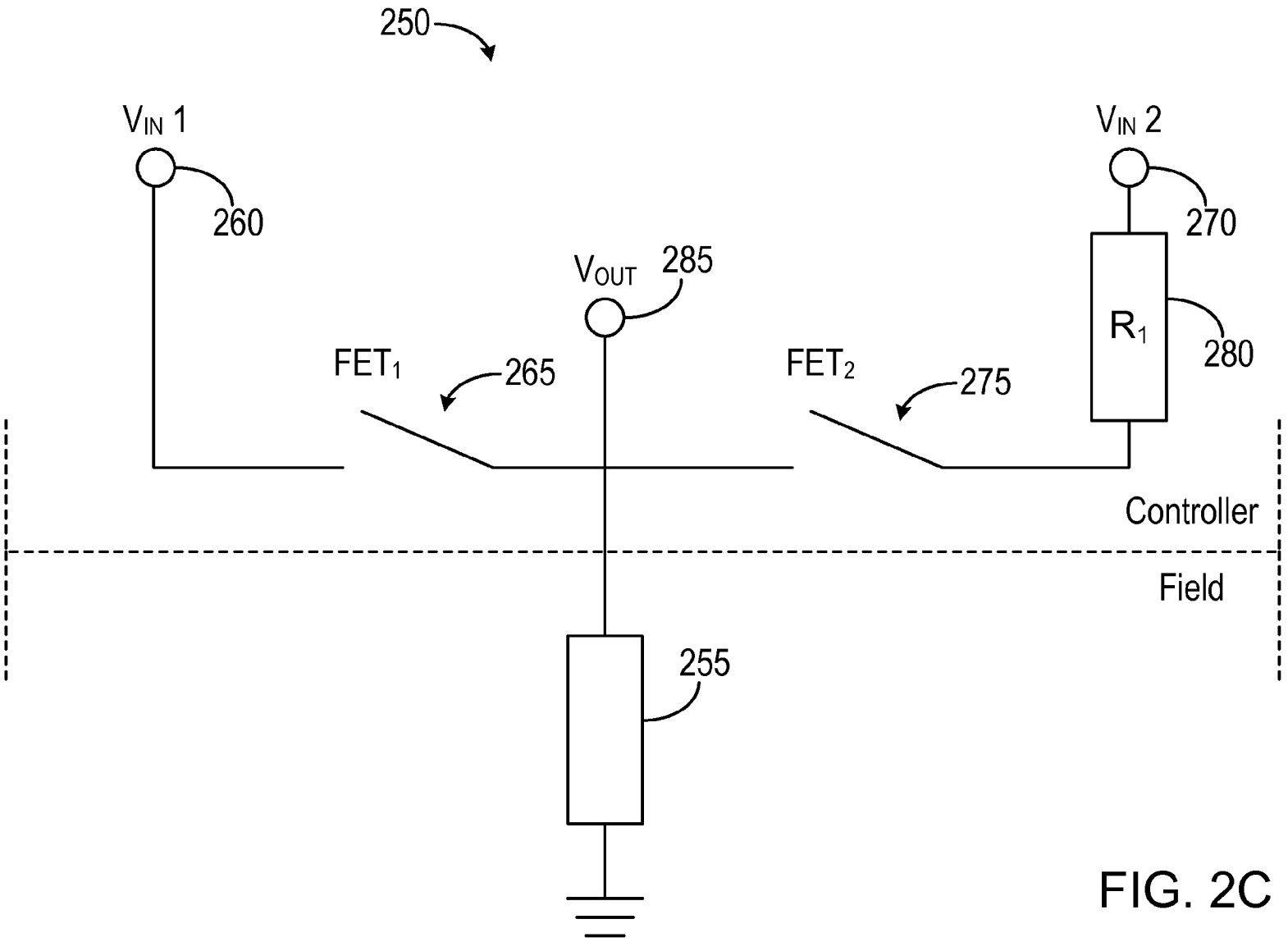
FIG. 2C schematically shows an example circuit for controlling and monitoring a vapor blocking valve.
Figure 3:
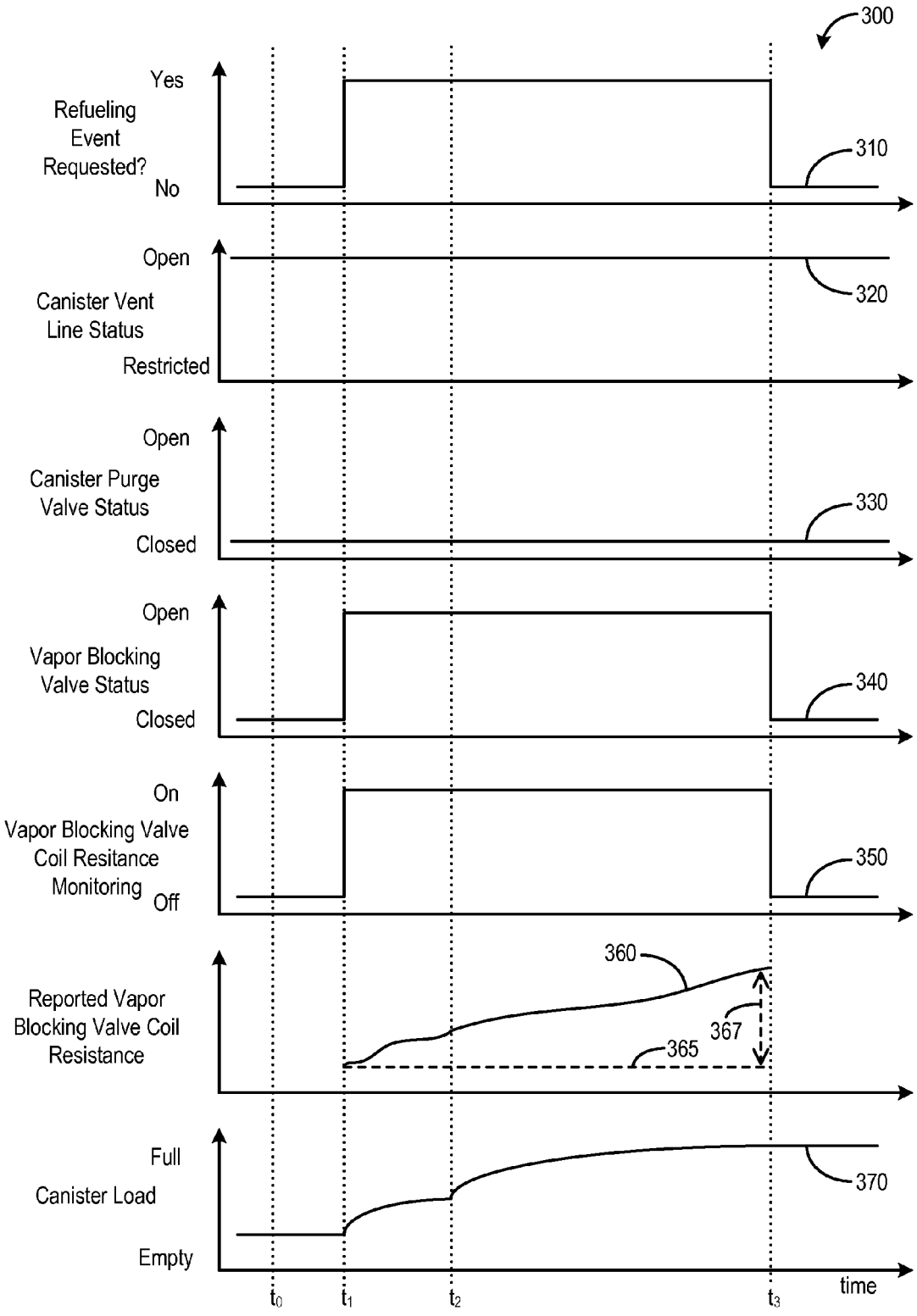
FIG. 3 shows an example timeline for a refueling event using the systems of FIGS. 1, 2A, and 2C.
Figure 4:
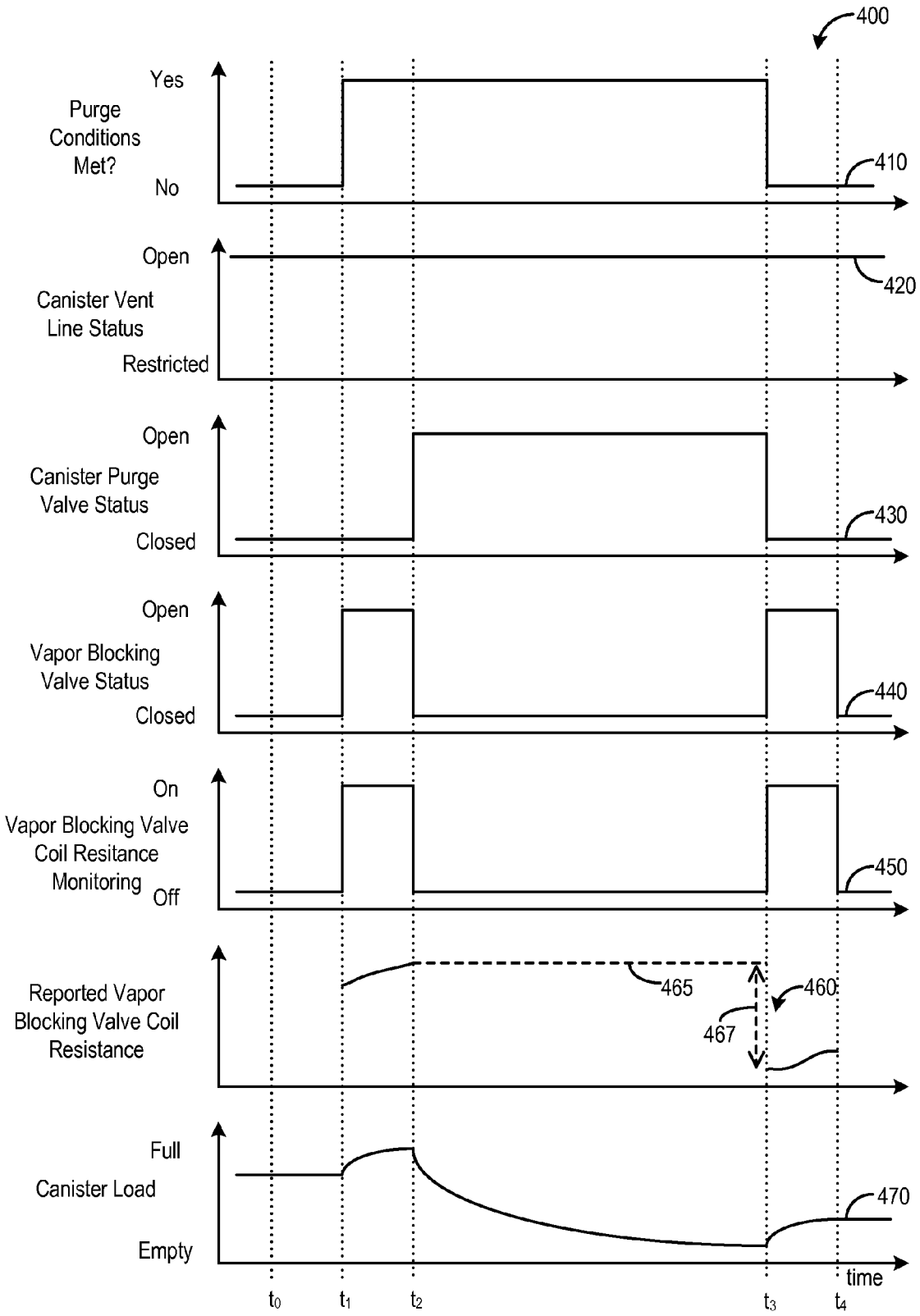
FIG. 4 shows an example timeline for a canister purge event using the systems of FIGS. 1, 2A 2C.

The following description relates to systems and methods for an emissions control system for a fuel system, which may be coupled to a vehicle engine, as shown in FIG. 1. In particular, the description relates to a fuel vapor canister configured such that a vapor blocking valve which regulates flow of fuel vapor between a fuel tank and the fuel vapor canister is located internal to the canister, as shown in FIG. 2A. The conformation of the vapor blocking valve may be regulated by a valve shaft coupled to a solenoid coil. The solenoid coil has an internal resistance that varies with temperature, as shown in FIG. 2B. The solenoid coil may be energized by coupling the coil to a voltage source, thus generating a magnetic field with a flux density great enough to adjust a position of the valve shaft, which may be latchable in the open and closed positions. When the coil is not energized, the internal resistance of the coil may be determined via a monitoring circuit, as depicted in FIG. 2C. In this way, the fuel vapor canister temperature may be inferred without requiring a dedicated canister temperature sensor. During canister loading, such as during fuel tank venting and refueling events, the fuel vapor canister adsorbs hydrocarbons in an exothermic reaction. As depicted in FIG. 3, the increase in canister temperature may be inferred via the vapor blocking valve resistance, which may in turn be used to determine the amount of fuel vapor adsorbed by the canister. Similarly, during a purge event, the desorption of fuel vapor is an endothermic reaction which results in a decrease in canister temperature, and thus vapor blocking valve resistance, as depicted in FIG. 4. As such, the vapor blocking valve resistance may be used to determine the working capacity of the fuel vapor canister by providing a quantitative readout of fuel vapor canister adsorption and desorption. The method depicted in FIG. 5 may thus be utilized as part of OBD testing to indicate canister degradation.

FIG. 1 shows a schematic depiction of a vehicle system 6. The vehicle system 6 includes an engine system 8 coupled to an emissions control system 51 and a fuel system 18. Emission control system 51 includes a fuel vapor container or canister 22 which may be used to capture and store fuel vapors. In some examples, vehicle system 6 may be a hybrid electric vehicle system.

The engine system 8 may include an engine 10 having a plurality of cylinders 30. The engine 10 includes an engine intake 23 and an engine exhaust 25. The engine intake 23 includes a throttle 62 fluidly coupled to the engine intake manifold 44 via an intake passage 42. The engine exhaust 25 includes an exhaust manifold 48 leading to an exhaust passage 35 that routes exhaust gas to the atmosphere. The engine exhaust 25 may include one or more emission control devices 70, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 18 may include a fuel tank 20 coupled to a fuel pump system 21. The fuel pump system 21 may include one or more pumps for pressurizing fuel delivered to the injectors of engine 10, such as the example injector 66 shown. While only a single injector 66 is shown, additional injectors are provided for each cylinder. It will be appreciated that fuel system 18 may be a return-less fuel system, a return fuel system, or various other types of fuel system. Fuel tank 20 may hold a plurality of fuel blends, including fuel with a range of alcohol concentrations, such as various gasoline-ethanol blends, including E10, E85, gasoline, etc., and combinations thereof. A fuel level sensor 34 located in fuel tank 20 may provide an indication of the fuel level ("Fuel Level Input") to controller 12. As depicted, fuel level sensor 34 may comprise a float connected to a variable resistor. Alternatively, other types of fuel level sensors may be used.

Vapors generated in fuel system 18 may be routed to an evaporative emissions control system 51 which includes a fuel vapor canister 22 via vapor recovery line 31, before being purged to the engine intake 23. Vapor recovery line 31 may be coupled to fuel tank 20 via one or more conduits and may include one or more valves for isolating the fuel tank during certain conditions. For example, vapor recovery line 31 may be coupled to fuel tank 20 via one or more or a combination of conduits 71, 73, and 75.

Further, in some examples, one or more fuel tank vent valves in conduits 71, 73, or 75. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 71 may include a grade vent valve (GVV) 87, conduit 73 may include a fill limit venting valve (FLVV) 85, and conduit 75 may include a grade vent valve (GVV) 83. Further, in some examples, recovery line 31 may be coupled to a fuel filler system 19. In some examples, fuel filler system may include a fuel cap 105 for sealing off the fuel filler system from the atmosphere. Refueling system 19 is coupled to fuel tank 20 via a fuel filler pipe or neck 11.

Further, refueling system 19 may include refueling lock 45. In some embodiments, refueling lock 45 may be a fuel cap locking mechanism. The fuel cap locking mechanism may be configured to automatically lock the fuel cap in a closed position so that the fuel cap cannot be opened. For example, the fuel cap 105 may remain locked via refueling lock 45 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 45 may be a filler pipe valve located at a mouth of fuel filler pipe 11. In such embodiments, refueling lock 45 may not prevent the removal of fuel cap 105. Rather, refueling lock 45 may prevent the insertion of a refueling pump into fuel filler pipe 11. The filler pipe valve may be electrically locked, for example by a solenoid, or mechanically locked, for example by a pressure diaphragm.

In some embodiments, refueling lock 45 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 45 is locked using an electrical mechanism, refueling lock 45 may be unlocked by commands from controller 12, for example, when a fuel tank pressure decreases below a pressure threshold. In embodiments where refueling lock 45 is locked using a mechanical mechanism, refueling lock 45 may be unlocked via a pressure gradient, for example, when a fuel tank pressure decreases to atmospheric pressure.

Emissions control system 51 may include one or more emissions control devices, such as one or more fuel vapor canisters 22 filled with an appropriate adsorbent, the canisters are configured to temporarily trap fuel vapors (including vaporized hydrocarbons) during fuel tank refilling operations and "running loss" (that is, fuel vaporized during vehicle operation). In one example, the adsorbent used is activated charcoal. Emissions control system 51 may further include a canister ventilation path or vent line 27 which may route gases out of the canister 22 to the atmosphere when storing, or trapping, fuel vapors from fuel system 18.

Canister 22 may include a buffer **22*a* (or buffer region), each of the canister and the buffer comprising the adsorbent. As shown, the volume of buffer 22*a* may be smaller than (e.g., a fraction of) the volume of canister 22. The adsorbent in the buffer 22*a* may be same as, or different from, the adsorbent in the canister (e.g., both may include charcoal). Buffer 22*a* may be positioned within canister 22 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 32 may be coupled to and/or within canister 22**. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 27 may also allow fresh air to be drawn into canister 22 when purging stored fuel vapors from fuel system 18 to engine intake 23 via purge line 28 and purge valve 61. For example, purge valve 61 may be normally closed but may be opened during certain conditions so that vacuum from engine intake manifold 44 is provided to the fuel vapor canister for purging. In some examples, vent line 27 may include an air filter 59 disposed therein upstream of a canister 22.

Flow of air and vapors between canister 22 and the atmosphere may be regulated by a canister vent valve 29. Canister vent valve 29 may be a normally open valve, so that vapor blocking valve 52 (VBV) may control venting of fuel tank 20 with the atmosphere. VBV 52 may be positioned between the fuel tank and the fuel vapor canister, which may be fluidically coupled via conduit 78. As described further herein and with reference to FIG. 2, VBV 52 may be located within canister 22. VBV 52 may be a normally closed valve, that when opened, allows for the venting of fuel vapors from fuel tank 20 to canister 22. Fuel vapors may then be vented to atmosphere via canister vent valve 29, or purged to engine intake system 23 via canister purge valve 61.

Fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open VBV 52 and canister vent valve 29 while closing canister purge valve (CPV) 61 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open VBV 52 and canister vent valve 29, while maintaining canister purge valve 61 closed, to depressurize the fuel tank before allowing enabling fuel to be added therein. As such, VBV 52 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 12 may open canister purge valve 61 and canister vent valve 29 while closing VBV 52. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold.

Fuel vapor adsorption within the fuel vapor canister is an exothermic reaction, while fuel vapor desorption is an endothermic reaction. As such, the fuel vapor canister may experience an increase in temperature during refueling and fuel tank venting events, and may experience a decrease in temperature during purge events. The fuel vapor canister may include an indicator of changes in fuel vapor canister temperature resulting from fuel vapor adsorbing to adsorbent material within the fuel vapor canister, and/or an indicator of changes in fuel vapor canister temperature resulting from fuel vapor desorbing from adsorbent material within the fuel vapor canister. A single indicator may respond to both increases and decreases in fuel vapor canister temperature. In some examples, the indicator may be included in the vapor blocking valve. Such a configuration is described herein with reference to FIGS. 2A-2C.

Controller 12 may comprise a portion of a control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 37 located upstream of the emission control device, temperature sensor 33, and pressure sensor 91. Other sensors such as pressure, temperature, air/fuel ratio, and composition sensors may be coupled to various locations in the vehicle system 6. As another example, the actuators may include fuel injector 66, throttle 62, vapor blocking valve 52, pump 92, and refueling lock 45. The control system 14 may include a controller 12. The controller may receive input data from the various sensors, process the input data, and trigger the actuators in response to the processed input data based on instruction or code programmed therein corresponding to one or more routines. An example control routine is described herein with regard to FIGS. 5A-5B.

Leak detection routines may be intermittently performed by controller 12 on fuel system 18 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed by an evaporative leak check module (ELCM) 95 communicatively coupled to controller 12. ELCM 95 may be coupled in vent 27, between canister 22 and the atmosphere. ELCM 95 may include a vacuum pump for applying negative pressure to the fuel system when administering a leak test. ELCM 95 may further include a reference orifice and a pressure sensor 96. Following the applying of vacuum to the fuel system, a change in pressure at the reference orifice (e.g., an absolute change or a rate of change) may be monitored and compared to a threshold. Based on the comparison, a fuel system leak may be diagnosed.

FIG. 2A shows a detailed schematic diagram of an example fuel vapor canister 200. Canister 200 may comprise a load input 202 that may be coupled to a fuel tank via a conduit, such as conduit 78 as shown in FIG. 1. In some examples, load input 202 may be coupled to a canister buffer, such as canister buffer **22*a*, as shown in FIG. 1. Canister 200 may further comprise a fresh air input 203 that may be coupled to atmosphere via a canister vent line, such as vent 27, as show in FIG. 1. Canister 200 may further include a purge output 204 that may be coupled to engine intake via a purge line, such as purge line 28, as shown in FIG. 1. Load input 202 may facilitate the flow of fuel vapor into canister 200 via load conduit 206. Load conduit 206 may extend into central cavity 207 of canister 200. Similarly, fresh air input 203 may facilitate the flow of fresh air into and gasses stripped of fuel vapor out of canister 200 via fresh air conduit 208. Fresh air conduit 208 may extend into central cavity 207 of canister 200. Purge conduit 209 may extend into central cavity 207 and may facilitate the flow of fuel vapor out of canister 200 and into purge output 204. In some examples, a partition 210 may extend between fresh air conduit 208 and conduits 206 and 209 to facilitate distribution of fuel vapor and fresh air throughout central cavity 207, though partition 209 may not completely isolate the fresh air side of canister 200** from the load side.

Canister 200 may be filled with an adsorbent material 212. Adsorbent material 212 may comprise any suitable material for temporarily trapping fuel vapors (including vaporized hydrocarbons) generated during fuel tank refueling operations, as well as diurnal vapors. In one example, adsorbent material 212 is activated charcoal. Fuel vapor entering central cavity 207 via load conduit 206 may bind to adsorbent material, while gasses stripped of fuel vapor may then exit canister 200 via fresh air conduit 208. Conversely, during a purge operation, fresh air may enter central cavity 207 via fresh air conduit 208, while desorbed fuel vapor may then exit canister 200 via purge conduit 209.

In this example, vapor blocking valve 215 is shown coupled to load conduit 206. Vapor blocking valve 215 may be positioned to regulate the flow of fuel vapor into fuel vapor canister 200 via load conduit 206. For example, vapor blocking valve may be operable between an open configuration, whereby the fuel vapor canister and fuel tank are fluidically coupled, and a closed configuration, whereby the fuel vapor canister and fuel tank are not coupled. In some examples, vapor blocking valve may be operable to one or more intermediate positions, and/or may be operable to one or more intermediate duty cycles.

Vapor blocking valve 215 may be a solenoid valve. Vapor blocking valve 215 is shown including solenoid coil 218. Solenoid coil 218 may be energized based on signals from a controller, such as controller 12, as shown in FIG. 1. Upon energization, solenoid coil 218 may output a magnetic field, which may cause a valve shaft to change positions relative to the solenoid coil. For example, the valve shaft may move between an open and closed position. Vapor blocking valve 215 may be a latchable valve. As such, the valve shaft may be movable between open and closed positions upon solenoid coil 218 receiving a brief energization pulse (e.g. 100 ms). In some examples, vapor blocking valve 215 may be a non-latching valve, and biased to be in an open or closed conformation by default, and may thus require the constant application of voltage to solenoid coil 218 to maintain the valve in the secondary (non-default) position.

Vapor blocking valve 215 and solenoid coil 218, extend into central cavity 207. In this way, solenoid coil 218 is positioned near load conduit 206 and purge conduit 209. During canister loading, such as during a refueling event, fuel vapor adsorbing to the adsorbent material 212 is an exothermic reaction. In particular, the adsorbent material in the region of central cavity 207 that surrounds load conduit 206 will experience an increased temperature during a majority of canister loading events. Similarly, during canister purging, fuel vapor desorbing from the adsorbent material 212 is an endothermic reaction. In particular, the adsorbent material in the region of central cavity 207 that surrounds purge conduit 209 will experience a decreased temperature during a majority of canister purging events. Fuel vapor canisters may age over time and are subject to contaminants such as water or liquid fuel, decreasing their capacity. Canister loading may be determined based on the exothermic nature of adsorption and endothermic nature of desorption. However, using a dedicated temperature sensor adds additional cost and system complexity to the emissions control system.

In the configuration depicted in FIG. 2A, solenoid coil 218 will experience the increases and decreases in canister temperature during loading and purging events, respectively. As the resistance of the solenoid coil is a function of temperature, the coil resistance may thus be utilized to infer canister loading and unloading. If the solenoid coil resistance does not increase during refueling, it may thus be inferred that the fuel vapor canister is no longer adsorbing fuel vapor. Similarly, if the solenoid coil resistance does not decrease during purging, the fuel vapor canister is no longer desorbing fuel vapor. FIG. 2B shows an example plot 235 depicting the relationship between the resistance and temperature of a solenoid valve coil. While this configuration includes a VBV solenoid positioned within the fuel vapor canister and a CPV solenoid positioned external to the fuel vapor canister, in other configurations, the CPV solenoid may be positioned within the fuel vapor canister central cavity in addition to or as an alternative to an internally positioned VBV solenoid. For example, a CPV solenoid may be coupled to purge conduit 209, and may be positioned to indicate changes in canister temperature during purge and/or loading events. Further, a CVV solenoid may be positioned within the fuel vapor canister, for example, coupled to fresh air conduit 208.

FIG. 2C shows an example circuit 250 that may be used by a controller to both adjust a position of a vapor blocking valve as well as to determine a resistance of the vapor blocking valve solenoid coil. Circuit 250 includes solenoid coil 255. Solenoid coil 255 may be selectively coupled to a first input voltage ($V_{in}1$) 260 in response to an indication to vent fuel vapor from the fuel tank to the fuel vapor canister, such as prior to and during a refueling event. First input voltage 260 may be a 12V input, such as the vehicle battery. Solenoid coil 255 is shown coupled to first input voltage 260 via first field effect transistor ($FET_1$) 265. In this way, a controller may actuate $FET_1$ to couple solenoid coil 255 to first input voltage 260, thus causing the solenoid coil to energize, and thus adjust a position of a valve shaft. For example, if solenoid coil 255 is coupled to a default-open valve shaft, $FET_1$ 265 may be actuated to close the valve, and de-actuated to open the valve. If solenoid coil 255 is coupled to a default-closed valve shaft, $FET_1$ 265 may be actuated to open the valve, and de-actuated to close the valve. If solenoid coil 255 is coupled to a latchable valve shaft, $FET_1$ 265 may be pulse-actuated to open the valve, and pulse-actuated again to close the valve.

In circuit 250, solenoid coil 255 is shown selectively coupled to a second input voltage ($V_{in}2$) 270. Second input voltage 270 may have a lower voltage than first input voltage 260, for example 5V, although other voltages may be used. Solenoid coil 255 is shown coupled to second input voltage 270 via a second field effect transistor ($FET_2$) 275. In this way, a controller may actuate $FET_2$ to couple solenoid coil 255 to second input voltage 270. However, the reduced voltage of second input voltage 270 does not cause the solenoid coil to energize to the extent necessary to adjust the position of the valve shaft. $FET_2$ 275 may be actuated during a refueling event or other conditions where a solenoid coil resistance and/or canister temperature measurement is indicated, discussed further herein with reference to FIGS. 5A-B.

A resistor ($R_1$) 280 is shown coupled between second input voltage 270 and $FET_2$ 275. In this way, an output voltage ($V_{out}$) 285, is indicative of the resistance of solenoid coil 255. For examples where second input voltage 270 is a 5V input, the resistance of solenoid coil 255 may be determined via the following equation:

$$V_{out}=5*R_{solenoid}/[R_{solenoid}+R_1]$$

The solenoid coil temperature may then be determined based on $R_{solenoid}$ and the inherent properties of the solenoid (e.g., inherent inductance, temperature/resistance relationship, activation status, valve shaft position). As described above, the solenoid coil temperature may then be used to determine a canister temperature profile, which may then be used to determine canister adsorption/desorption, and which in turn may be used to determine a working capacity of the fuel vapor canister. As shown in FIG. 2C, solenoid coil 255 is located in the "field" (e.g., coupled within the vapor blocking valve), while the other components of circuit 250 are coupled within the vehicle controller. However, other configurations and circuit designs may be used without departing from the scope of this disclosure.

FIG. 3 shows an example timeline 300 for a refueling event for a fuel system comprising a vapor blocking valve positioned within a fuel vapor canister, such as the vapor blocking valve and fuel vapor canister depicted in FIG. 2A, wherein the vapor blocking valve solenoid coil is coupled to a controller via a control-and-monitoring circuit, such as the circuit depicted in FIG. 2C. The vapor blocking valve in this example may be considered a latchable, default-closed valve. Timeline 300 includes plot 310, indicating whether a refueling request has been received over time. Timeline 300 further includes plot 320, indicating a canister vent line status over time; plot 330, indicating a canister purge valve status over time; and plot 340, indicating a vapor blocking valve status over time. Timeline 300 further includes plot 350, indicating whether vapor blocking valve coil resistance monitoring is activated over time; and plot 360, indicating a reported vapor blocking valve coil resistance over time. Line 365 represents an initial coil resistance, while line 367 represents change in coil resistance over the refueling event. Timeline 300 further includes plot 370, indicating a canister load over time.

At time $t_0$, no refueling event has been requested, as indicated by plot 310. Accordingly, the canister vent line is open, as indicated by plot 320, the canister purge valve is closed, as indicated by plot 330, and the vapor blocking valve is closed, as indicated by plot 340. Vapor blocking valve coil resistance is not being monitored, as indicated by plot 350.

At time $t_1$, a refueling event is requested. Accordingly, the vapor blocking valve is opened. Further, vapor blocking valve coil resistance monitoring is activated. For example, as depicted in FIG. 2C, a FET coupled between the coil and a secondary voltage source may be activated. A vapor blocking valve coil resistance is then reported, as indicated by plot 360. This initial resistance is recorded, as indicated by line 365. Opening of the vapor blocking valve causes fuel vapor to be vented from the fuel tank to the fuel vapor canister. Accordingly, the canister load increases, as indicated by plot 370. The adsorption results in an increase in canister temperature, which in turn causes the vapor blocking valve coil disposed within the canister to heat up. As such, the reported vapor blocking valve coil resistance increases.

At time $t_2$, fuel dispensation into the fuel tank is initiated. Fuel vapor generated during fuel dispensation is vented through the vapor blocking valve into the fuel vapor canister. Accordingly, the canister load increases as fuel vapor is adsorbed, resulting in an increase in canister temperature and vapor blocking valve coil temperature. As such, the reported vapor blocking valve coil resistance increases from time $t_2$ to time $t_3$. At time $t_3$, the refueling event ends. The vapor blocking valve is then closed, and the vapor blocking valve coil resistance is no longer reported. The vapor blocking valve coil resistance at time $t_3$ may be compared to the initial vapor blocking coil resistance to determine a resistance change over the refueling event, as indicated by line 367. The resistance change may be used to determine the amount of fuel vapor adsorbed by the fuel vapor canister, and thus to update a canister purge schedule based on the canister load.

Turning to FIG. 4, an example timeline 400 is shown for a canister purging event for a fuel system comprising a vapor blocking valve positioned within a fuel vapor canister, such as the vapor blocking valve and fuel vapor canister depicted in FIG. 2A, wherein the vapor blocking valve solenoid coil is coupled to a controller via a control-and-monitoring circuit, such as the circuit depicted in FIG. 2C. Similarly to FIG. 3, the vapor blocking valve in this example may be considered a latchable, default-closed valve. Timeline 400 includes plot 410, indicating whether a canister purge conditions are met over time. Timeline 400 further includes plot 420, indicating a canister vent line status over time; plot 430, indicating a canister purge valve status over time; and plot 440, indicating a vapor blocking valve status over time. Timeline 400 further includes plot 450, indicating whether vapor blocking valve coil resistance monitoring is activated over time; and plot 460, indicating a reported vapor blocking valve coil resistance over time. Line 465 represents an initial coil resistance, while line 467 represents change in coil resistance over the purge event. Timeline 400 further includes plot 470, indicating a canister load over time.

At time $t_0$, purge conditions are not met, as indicated by plot 410. Accordingly, the canister vent line is open, as indicated by plot 420, the canister purge valve is closed, as indicated by plot 430, and the vapor blocking valve is closed, as indicated by plot 440. Vapor blocking valve coil resistance is not being monitored, as indicated by plot 450.

At time $t_1$, purge conditions are met. Prior to initiating the purge, the vapor blocking valve coil resistance is sampled. Accordingly, the vapor blocking valve is opened, and the vapor blocking valve coil resistance monitoring is activated. For example, as depicted in FIG. 2C, a FET coupled between the coil and a secondary voltage source may be activated. A vapor blocking valve coil resistance is then reported, as indicated by plot 460. The opening of the vapor blocking valve causes fuel vapor to be vented from the fuel tank to the fuel vapor canister. Accordingly, the canister load increases, as indicated by plot 470. The adsorption results in an increase in canister temperature, which in turn causes the vapor blocking valve coil disposed within the canister to heat up. As such, the reported vapor blocking valve coil resistance increases. This initial resistance is recorded, as indicated by line 465.

At time $t_2$, canister purging is initiated. Accordingly, vapor blocking valve coil resistance monitoring is de-activated, the vapor blocking valve is closed, and the canister purge valve is opened. This conformation is maintained from time $t_2$ to time $t_3$. As fuel vapor is desorbed, the canister load decreases. At time $t_3$, the purge event ends. The canister purge valve is thus closed. The vapor blocking valve coil resistance is then re-sampled. Accordingly, the vapor blocking valve is opened, and the vapor blocking valve coil resistance monitoring is activated. The desorption of fuel vapor during the purge event resulted in a decrease in canister temperature and vapor blocking valve coil temperature. As such, the reported vapor blocking valve coil resistance decreases from time $t_2$ to time $t_3$. The vapor blocking valve coil resistance at time $t_3$ may be compared to the initial vapor blocking valve coil resistance to determine a resistance change over the refueling event, as indicated by line 467. The resistance change may be used to determine the amount of fuel vapor adsorbed by the fuel vapor canister, and thus to update a canister purge schedule based on the canister load. The opening of the vapor blocking valve at time $t_3$ results in fuel vapor venting from the fuel tank to the fuel vapor canister. Accordingly, the canister load increases, resulting in an increase in canister temperature, which in turn causes the vapor blocking valve coil disposed within the canister to heat up. As such, the reported vapor blocking valve coil resistance increases. At time $t_4$, the vapor blocking valve is closed, and the vapor blocking valve coil resistance monitoring is discontinued.

In order to verify or diagnose the integrity of a fuel vapor canister, a canister working capacity diagnostic may be used to discern and quantify the ability of the fuel vapor canister to adsorb and desorb hydrocarbons. Indeed, such a diagnostic may be incorporated into federal emissions regulations for certain vehicles. As discussed herein, canister temperature changes may be used to determine canister loading and unloading, and thus may be used to infer canister working capacity. By implementing a canister with an internally located vapor blocking solenoid valve, the canister working capacity may be inferred without requiring a dedicated canister temperature sensor. Further, if the vapor blocking valve coil is energized prior to canister purging (as shown in timeline 400), the coil may heat up, causing the adsorbent to heat up, thus increasing the efficiency of a canister purging routine.

Figure 5A:
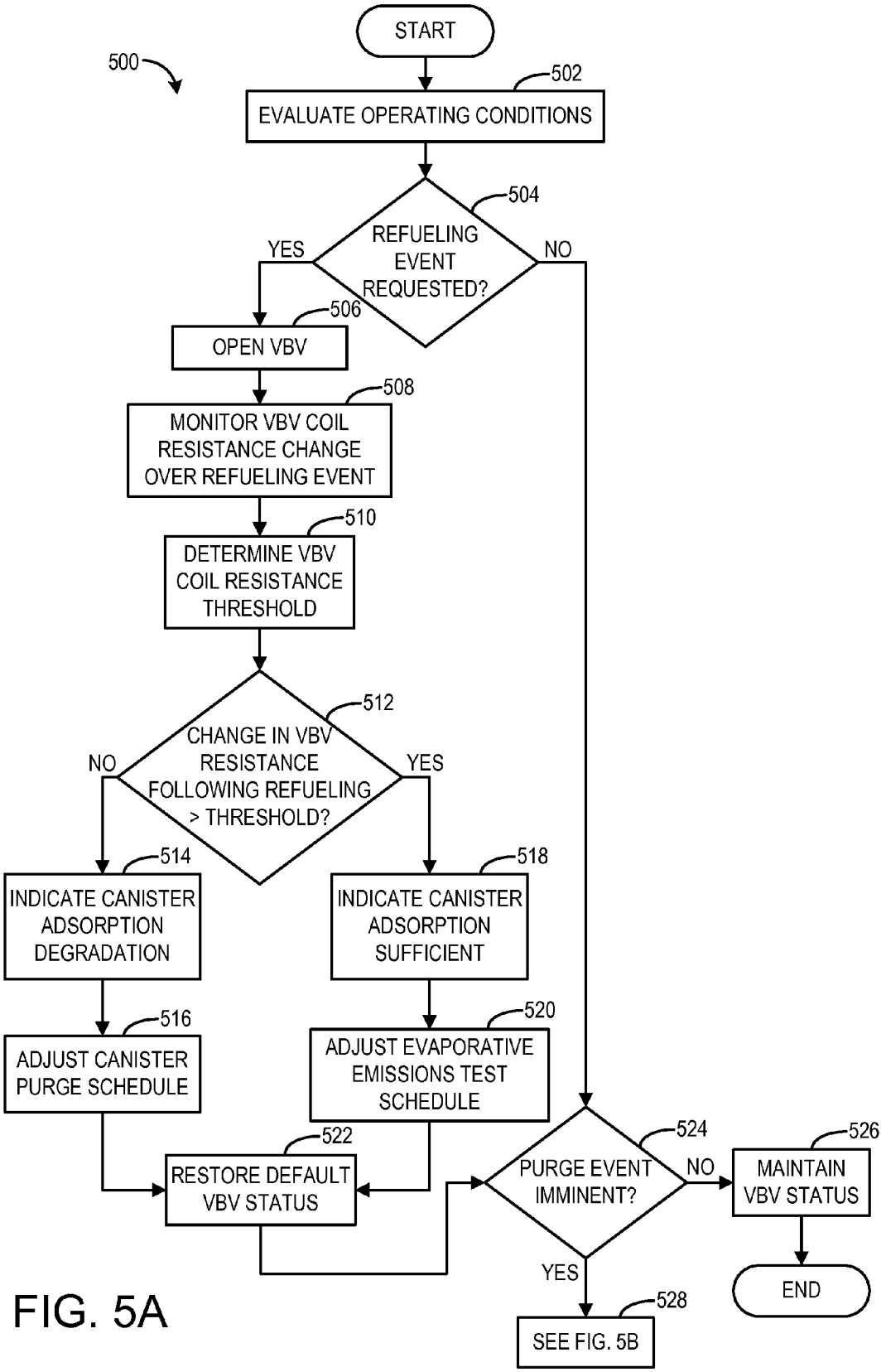
FIGS. 5A-5B show a flow chart for an example high-level method for determining degradation of a fuel vapor canister.
Figure 5B:
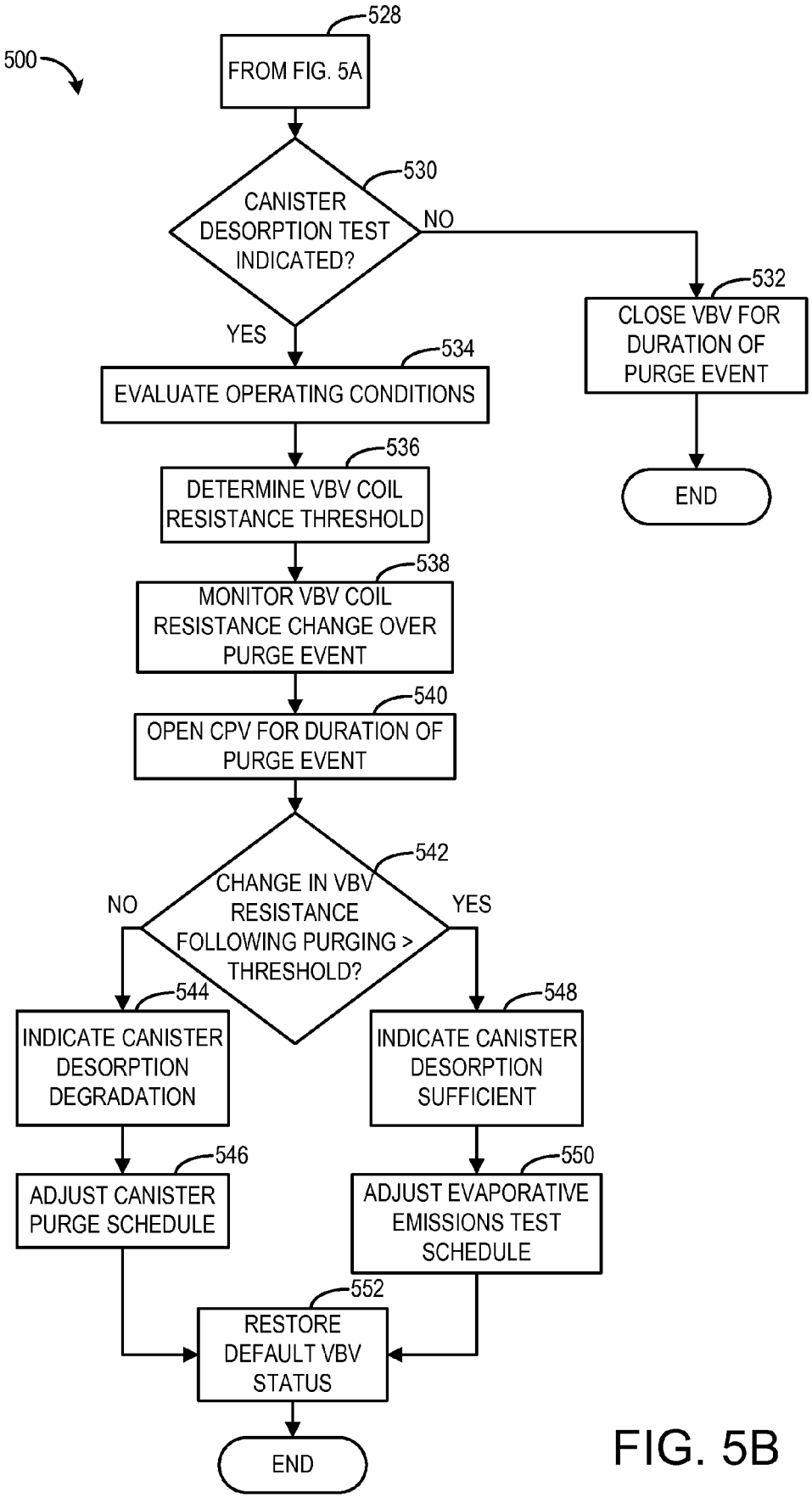

FIGS. 5A-5B show an example method 500 for a fuel vapor canister working capacity diagnostic routine. Method 500 will be described with reference to the systems described herein and depicted in FIGS. 1, 2A, and 2C, but it should be understood that method 500 and similar methods may be applied to other systems without departing from the scope of the disclosure. Instructions for carrying out method 500 and the rest of the methods included herein may be executed by a controller based on instructions stored in non-transitory memory of the controller and in conjunction with signals received from sensors of the engine system, such as the sensors described above with reference to FIG. 1. The controller may employ engine actuators of the engine system to adjust engine operation, according to the methods described below.

Method 500 begins at 502. At 502, method 500 includes evaluating operating conditions. Operating conditions may be measured, estimated or inferred, and may include various vehicle conditions, such as vehicle speed and vehicle location, various engine operating conditions, such as engine operating mode, engine speed, engine temperature, exhaust temperature, boost level, MAP, MAF, torque demand, horsepower demand, etc., and various ambient conditions, such as temperature, barometric pressure, humidity, etc.

Continuing at 504, method 500 includes determining whether a refueling event has been requested. For example, a vehicle instrument panel may include a refueling button which may be manually actuated or pressed by a vehicle operator to initiate refueling. Detecting depression of the refueling request button may indicate that a refueling event is imminent. In other examples, determining whether a refueling event is imminent may include detecting proximity to a refueling station. For example, the vehicle's proximity to a refueling station may be determined via an on-board GPS or through wireless communication between the vehicle and a refueling pump. In other examples, a refueling event may be inferred by the vehicle operator (or a refueling attendant) opening a refueling door or otherwise attempting to gain access to the vehicle fuel filler system.

If a refueling request is received, method 500 proceeds to 506. At 506, method 500 includes opening the VBV. For example, the VBV solenoid coil may be coupled to a voltage source in order to energize the coil and adjust a position of the VBV valve shaft. By opening the VBV, the fuel tank may be depressurized prior to the initiation of the refueling event.

Continuing at 508, method 500 includes monitoring the VBV coil resistance for the duration of the refueling event. For example, as shown in FIG. 2C, the VBV coil may be coupled to a voltage source that is insufficient to energize the coil, and an output voltage representative of a VBV coil resistance may be monitored. In some examples, an initial VBV coil resistance may be sampled, and the coil resistance may be sampled again following refueling. In other examples, the VBV coil resistance may be monitored continuously for the duration of the refueling event.

Continuing at 510, method 500 includes determining a VBV resistance threshold. The VBV resistance threshold may represent a change in resistance of the VBV from the initiation of the refueling event to the completion of the refueling event, thus indicating a change in canister temperature corresponding to an amount of fuel vapor adsorbed within the canister. The threshold may be based on the inherent properties of the VBV coil, an initial VBV coil resistance, ambient temperature, a monitoring voltage level, fuel tank pressure, fuel tank fill level, fuel type, fuel volatility, fuel tank temperature, canister load, etc. and may be updated based on an amount and type of fuel added to the fuel tank during the refueling event. In other words, the threshold may represent an expected change in VBV coil resistance based on an expected change in canister temperature, which may be based on an expected amount of fuel vapor adsorption during the refueling event.

Continuing at 512, method 500 may include determining whether a change in VBV coil resistance following the refueling event is greater than the threshold. The threshold may be adjusted based on the amount and type of fuel added during the refueling event. The change in VBV coil resistance may be based on a continuous monitoring of the VBV coil resistance over the refueling event and/or an initial VBV coil resistance and a final VBV coil resistance. If the change in VBV coil resistance following the refueling event is not greater than the threshold (e.g., the fuel vapor canister adsorbed less hydrocarbons than expected), method 500 proceeds to 514. At 514, method 500 includes indicating degradation of the fuel vapor canister. Indicating degradation of the fuel vapor canister may include setting a diagnostic code at the controller, and may further include illuminating a malfunction indicator light (MIL). Continuing at 516, method 500 includes adjusting a canister purge schedule. For example, if the fuel vapor canister is adsorbing fewer hydrocarbons than expected, a canister purge schedule may be adjusted to purge the canister with an increased purge flow summation prior to and/or following a refueling event. In some examples, the canister vent may be closed when the fuel vapor canister is not being purged.

Returning to 512, if the change in VBV coil resistance following the refueling event is greater than the threshold (e.g., the fuel vapor canister adsorbed at least the amount of hydrocarbons expected), method 500 proceeds to 518. At 518, method 500 includes indicating that fuel vapor canister adsorption is sufficient. Indicating that the fuel vapor canister adsorption is sufficient may include recording the passing test at the controller. Continuing at 520, method 500 includes adjusting an evaporative emissions test schedule based on the passing test result. For example, future leak test parameters may be updated to reflect the capacity of the fuel vapor canister. Further, the timing of future canister working capacity tests may be adjusted. For example, an adsorption test may be scheduled for a future time point based on the passing test result, and a desorption test may be scheduled for a future time point based on the passing test result.

At 522, method 500 includes restoring the default VBV status. In this example, the VBV may be closed, as it is a normally-closed valve. However, in some examples, the VBV may be opened. In scenarios where the fuel vapor canister adsorption test failed, the VBV may be closed regardless of the default status. In scenarios where the fuel vapor canister adsorption test passed, the VBV may be opened regardless of the default status. Method 500 then proceeds to 524.

Returning to 504, if no refueling event is requested, method 500 may proceed to 524. At 524, method 500 includes determining whether a purge event is imminent. Determining whether a purge event is imminent may include determining whether a canister load is above a threshold, and determining whether conditions for purging are met, such as engine operating status, engine intake vacuum level, and commanded A/F ratio. If no purge event is imminent, method 500 proceeds to 526. At 526, method 500 includes maintaining the status of the VBV. Method 500 then ends.

If a purge event is imminent, method 500 proceeds to 528. This branch of method 500 is described with reference to FIG. 5B. At 530, method 500 includes determining whether a canister desorption test is indicated. Determining whether a canister desorption test is indicated may include determining whether a flag has been set at the controller indicating that a desorption test should be performed during the next canister purge event. A desorption test may be indicated once a duration has elapsed since a previous desorption test, and/or in response to other emissions system testing, such as a canister adsorption test. If a canister desorption test is not indicated, method 500 proceeds to 532. At 532, method 500 includes maintaining the VBV closed for the duration of the purge event. Method 500 may then end.

If a canister desorption test is indicated, method 500 proceeds to 534. At 534, method 500 includes evaluating operating conditions, such as engine speed, boost level, MAP, MAF, canister load, ambient temperature, barometric pressure, humidity, etc. Continuing at 536, method 500 includes determining a VBV coil resistance threshold. The threshold may be based on the inherent properties of the VBV coil, an initial VBV coil resistance, ambient temperature, a monitoring voltage level, canister load, engine operating conditions, etc. and may be updated based on an amount of purge air flow through the canister during the purge event. In other words, the threshold may represent an expected change in VBV coil resistance based on an expected change in canister temperature, which may be based on an expected amount of hydrocarbon desorption during the purge event.

Continuing at 538, method 500 may include monitoring the VBV coil resistance change over the duration of the purge event. For example, as shown in FIG. 2C, the VBV coil may be coupled to a voltage source that is insufficient to energize the coil, and an output voltage representative of a VBV coil resistance may be monitored. As described with regards to FIG. 4, in some examples, an initial VBV coil resistance may be sampled where the VBV is opened prior to the purge event, and the coil resistance may be sampled again following the purge event. In other examples, the VBV coil resistance may be monitored continuously for the duration of the purge event. Continuing at 540, method 500 includes opening the CPV for the duration of the purge event. The duty cycle of the CPV may be held constant over the purge event, or may be varied. For example, the duty cycle may be gradually ramped up (CPV gradually opened) in order to prevent engine stalling.

Continuing at 542, method 500 may include determining whether a change in VBV coil resistance following the purge event is greater than the threshold. The threshold may be adjusted based on the amount of purge air flow over the purge event. The change in VBV coil resistance may be based on a continuous monitoring of the VBV coil resistance over the purge event and/or an initial VBV coil resistance and a final VBV coil resistance. If the change in VBV coil resistance following the purge event is not greater than the threshold (e.g., the fuel vapor canister desorbed less hydrocarbons than expected), method 500 proceeds to 544. At 544, method 500 includes indicating degradation of the fuel vapor canister. Indicating degradation of the fuel vapor canister may include setting a diagnostic code at the controller, and may further include illuminating a malfunction indicator light (MIL). Continuing at 546, method 500 includes adjusting a canister purge schedule. For example, if the fuel vapor canister is desorbing fewer hydrocarbons than expected, a canister purge schedule may be to purge the canister with an increased purge flow summation prior to and/or following a refueling event, and/or may be adjusted to include a canister and/or purge air heating operation.

Returning to 542, if the change in VBV coil resistance following the purge event is greater than the threshold (e.g., the fuel vapor canister desorbed at least the amount of hydrocarbons expected), method 500 proceeds to 548. At 548, method 500 includes indicating that fuel vapor canister desorption is sufficient. Indicating that the fuel vapor canister desorption is sufficient may include recording the passing test at the controller. Continuing at 550, method 500 includes adjusting an evaporative emissions test schedule based on the passing test result. For example, future leak test parameters may be updated to reflect the capacity of the fuel vapor canister. Further, the timing of future canister working capacity tests may be adjusted. For example, an adsorption test may be scheduled for a future time point based on the passing test result, and a desorption test may be scheduled for a future time point based on the passing test result.

At 552, method 500 includes restoring the default VBV status. In this example, the VBV may be closed, as it is a normally-closed valve. However, in some examples, the VBV may be opened. In scenarios where the fuel vapor canister desorption test failed, the VBV may be closed regardless of the default status. In scenarios where the fuel vapor canister desorption test passed, the VBV may be opened regardless of the default status. Method 500 may then end.

The systems described herein and with reference to FIGS. 1, 2A and 2C, along with the methods described herein and with reference to FIGS. 5A and 5B may enable one or more systems and one or more methods. In one example, a fuel system is provided, comprising a solenoid valve positioned to regulate flow of fuel vapor between a fuel tank and a fuel vapor canister, the solenoid valve including an indicator of changes in fuel vapor canister temperature resulting from fuel vapor adsorbing to adsorbent material within the fuel vapor canister. In such an example, the solenoid valve may additionally or alternatively include an indicator of changes in fuel vapor canister temperature resulting from fuel vapor desorbing from adsorbent material within the fuel vapor canister. In any of the preceding embodiments, the solenoid valve may be coupled to a load port of the fuel vapor canister such that a solenoid coil is located within a central cavity of the fuel vapor canister. In any of the preceding examples where the solenoid coil is located within the central cavity of the fuel vapor canister, the solenoid coil may additionally or alternatively be located between the load port and a purge port. In any of the preceding examples where the solenoid coil is located within a central cavity of the fuel vapor canister, the fuel system may additionally or alternatively comprise a first voltage source selectively coupled to the solenoid coil responsive to an indication to adjust a position of the solenoid valve, and a second voltage source selectively coupled to the solenoid coil responsive to an indication to monitor a resistance of the solenoid coil. In any of the preceding examples wherein the solenoid coil is coupled to a first and second voltage source, the second voltage source may additionally or alternatively have a lower voltage output than the first voltage source. In any of the preceding examples wherein a solenoid coil is located within a central cavity of the fuel vapor canister, the fuel system may additionally or alternatively comprise a controller coupled to the solenoid valve, the controller storing instructions in non-transitory memory that when executed cause the controller to determine an initial resistance of the solenoid coil at an initiation of a refueling event, determine a change in resistance of the solenoid coil over a duration of the refueling event, and indicate degradation of the fuel vapor canister responsive to the change in resistance being less than a threshold. In any of the preceding examples comprising a controller, the controller may additionally or alternatively store instructions in non-transitory memory that when executed cause the controller to determine an initial resistance of the solenoid coil at an initiation of a purge event, determine a change in resistance of the solenoid valve over a duration of the purge event, and indicate degradation of the fuel vapor canister responsive to the change in resistance being less than a threshold. The technical result of implementing such a fuel system is that a fuel vapor canister load may be determined based on adsorption or desorption of fuel vapor within the fuel vapor canister without requiring a dedicated temperature sensor positioned within the central cavity of the canister. In this way, canister performance may be monitored, while system cost and complexity may be maintained or reduced.

In another example, a method for a fuel system is provided, comprising indicating degradation of a fuel vapor canister based on a resistance of a vapor blocking valve solenoid coil during a refueling event, and adjusting a fuel vapor canister purge schedule based on the indicated degradation. In this way, if a fuel vapor canister capacity is diminished, the purge schedule may be adjusted to prevent excess fuel vapor from being released as bleed emissions. In such an example, indicating degradation of a fuel vapor canister based on the resistance of a vapor blocking valve solenoid coil during a refueling event may additionally or alternatively comprise determining an initial resistance of the vapor blocking valve solenoid coil at an initiation of the refueling event, determining a change in resistance of the vapor blocking valve solenoid coil over a duration of the refueling event, and indicating degradation of the fuel vapor canister responsive to the change in resistance being less than a threshold. In any of the preceding examples where an initial resistance of the vapor blocking valve solenoid coil is determined at an initiation of the refueling event, determining an initial resistance of the vapor blocking valve solenoid coil at an initiation of the refueling event may additionally or alternatively comprise opening the vapor blocking valve by coupling a first voltage source to the vapor blocking valve solenoid coil, and determining the initial resistance of the vapor blocking valve solenoid coil by coupling a second voltage source to the vapor blocking valve solenoid coil at the initiation of the refueling event, and determining a change in resistance of the vapor blocking valve solenoid coil over a duration of the refueling event may additionally or alternatively comprise determining a final resistance of the vapor blocking valve solenoid coil when the second voltage source is coupled to the vapor blocking valve solenoid coil at a completion of the refueling event. In any of the preceding example, the method may additionally or alternatively comprise determining an initial resistance of the vapor blocking valve solenoid coil at an initiation of a purge event, determining a change in resistance of the vapor blocking valve solenoid coil over a duration of the purge event, and indicating degradation of the fuel vapor canister responsive to the change in resistance being less than a threshold. In any of the preceding examples wherein a change in resistance of the vapor blocking valve solenoid coil is determined over a duration of the purge event, the method may additionally or alternatively comprise opening the vapor blocking valve by coupling a first voltage source to the vapor blocking valve solenoid coil, determining the initial resistance of the vapor blocking valve solenoid coil by coupling a second voltage source to the vapor blocking valve solenoid coil, opening a canister purge valve, purging fuel vapor from the fuel vapor canister to an engine intake for a duration, closing the canister purge valve, and determining a final resistance of the vapor blocking valve solenoid coil when the second voltage source is coupled to the vapor blocking valve solenoid coil at the completion of the purge event. In any of the preceding examples wherein a final resistance of the vapor blocking valve solenoid coil is determined at the completion of the purge event, the method may additionally or alternatively comprise: prior to opening the canister purge valve, closing the vapor blocking valve, following closing the canister purge valve, opening the vapor blocking valve, and following determining a final resistance of the vapor blocking valve solenoid coil, closing the vapor blocking valve. In any of the preceding examples where a fuel vapor purge schedule is adjusted, adjusting a fuel vapor canister purge schedule may additionally or alternatively comprise increasing a commanded purge air flow summation following a refueling event. The technical result of implementing this method is a reduction in vehicle emissions based on an accurate canister working capacity diagnostic. In this way, if the fuel vapor canister is aged, damaged, or otherwise degraded, and thus has a reduced capacity for adsorbing and desorbing fuel vapor, replacement of the canister may be indicated prior to the canister warrantee period elapsing.

In yet another example, a method for an evaporative emissions system is provided, comprising indicating degradation of a fuel vapor canister based on a resistance of a vapor blocking valve solenoid coil during a purge event, and adjusting an evaporative emissions test schedule based on a resistance of a vapor control valve solenoid coil mounted in a central cavity of the fuel vapor canister. In such an example, the method may additionally or alternatively comprise determining an expected change in resistance of the vapor blocking valve solenoid coil during a purge event, indicating an observed change in resistance of the vapor blocking valve solenoid coil over a duration of the purge event, and indicating fuel vapor canister desorption degradation responsive to the observed change in resistance being less than the expected change in resistance. In any of the preceding examples, the method may additionally or alternatively comprise indicating degradation of a fuel vapor canister based on a resistance of a vapor blocking valve solenoid coil during a refueling event. In any of the preceding examples where degradation of a fuel vapor canister is indicated based on a resistance of a vapor blocking valve solenoid coil during a refueling event, the method may additionally or alternatively comprise determining an expected change in resistance of the vapor blocking valve solenoid coil during a refueling event, indicating an observed change in resistance of the vapor blocking valve solenoid coil over a duration of the refueling event, and indicating fuel vapor canister adsorption degradation responsive to the observed change in resistance being less than the expected change in resistance. In any of the preceding examples, adjusting an evaporative emissions test schedule may additionally or alternatively comprise updating leak test parameters based on a working capacity of the fuel vapor canister, the working capacity based on the resistance of a vapor control valve solenoid coil. The technical result of implementing this method is a reduction in bleed emissions based on an accurate canister working capacity diagnostic. In this way, if the fuel vapor canister is aged, damaged, or otherwise degraded, and thus has a reduced capacity for adsorbing and desorbing fuel vapor, the canister may be purged more aggressively, and/or for a longer duration. For example, canister purging may be favored over fuel economy under certain operating conditions. In this way, bleed emissions may be mitigated until the fuel vapor canister is repaired or replaced.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fuel system, comprising:

a solenoid valve disposed in a passage between a fuel tank and a fuel vapor canister to regulate flow of fuel vapor between the fuel tank and the fuel vapor canister, the solenoid valve generating an indicator of changes in fuel vapor canister temperature responsive to fuel vapor adsorbing to adsorbent material within the fuel vapor canister while the solenoid valve is in an open position.

2. The fuel system of claim 1, wherein the solenoid valve further includes an indicator of changes in fuel vapor canister temperature resulting from fuel vapor desorbing from adsorbent material within the fuel vapor canister.

3. The fuel system of claim 2, wherein the solenoid valve is coupled to a load port of the fuel vapor canister such that a solenoid coil is located within a central cavity of the fuel vapor canister.

4. The fuel system of claim 3, wherein the solenoid coil is located within the central cavity of the fuel vapor canister between the load port and a purge port.

5. The fuel system of claim 3, further comprising:

a first voltage source selectively coupled to the solenoid coil responsive to an indication to adjust a position of the solenoid valve; and a second voltage source selectively coupled to the solenoid coil responsive to an indication to monitor a resistance of the solenoid coil.

6. The fuel system of claim 5, wherein the second voltage source has a lower voltage output than the first voltage source.

7. The fuel system of claim 3, further comprising:

a controller coupled to the solenoid valve, the controller storing instructions in non-transitory memory that when executed cause the controller to:

determine an initial resistance of the solenoid coil at an initiation of a refueling event;

determine a change in resistance of the solenoid coil over a duration of the refueling event; and indicate degradation of the fuel vapor canister responsive to the change in resistance being less than a threshold.

8. The fuel system of claim 7, wherein the controller further stores instructions in non-transitory memory that when executed cause the controller to:

determine an initial resistance of the solenoid coil at an initiation of a purge event;

determine a change in resistance of the solenoid valve over a duration of the purge event; and indicate degradation of the fuel vapor canister responsive to the change in resistance being less than a threshold.

9. A method for a fuel system, comprising:

indicating degradation of a fuel vapor canister based on a change in resistance of a vapor blocking valve solenoid coil while the vapor blocking valve is in an open position during a refueling event; and adjusting a fuel vapor canister purge schedule based on the indicated degradation.

10. The method of claim 9, where indicating degradation of a fuel vapor canister based on the change in resistance of a vapor blocking valve solenoid coil during a refueling event comprises:

determining an initial resistance of the vapor blocking valve solenoid coil at an initiation of the refueling event;

determining the change in resistance of the vapor blocking valve solenoid coil over a duration of the refueling event; and indicating degradation of the fuel vapor canister responsive to the change in resistance being less than a threshold.

11. The method of claim 10, wherein determining an initial resistance of the vapor blocking valve solenoid coil at an initiation of the refueling event further comprises:

opening a vapor blocking valve by coupling a first voltage source to the vapor blocking valve solenoid coil; and determining the initial resistance of the vapor blocking valve solenoid coil by coupling a second voltage source to the vapor blocking valve solenoid coil at the initiation of the refueling event; and wherein determining the change in resistance of the vapor blocking valve solenoid coil over a duration of the refueling event further comprises:

determining a final resistance of the vapor blocking valve solenoid coil when the second voltage source is coupled to the vapor blocking valve solenoid coil at a completion of the refueling event.

12. The method of claim 9, further comprising:

determining an initial resistance of the vapor blocking valve solenoid coil at an initiation of a purge event;

determining the change in resistance of the vapor blocking valve solenoid coil over a duration of the purge event; and indicating degradation of the fuel vapor canister responsive to the change in resistance being less than a threshold.

13. The method of claim 12, further comprising:

opening a vapor blocking valve by coupling a first voltage source to the vapor blocking valve solenoid coil;

determining the initial resistance of the vapor blocking valve solenoid coil by coupling a second voltage source to the vapor blocking valve solenoid coil;

opening a canister purge valve;

purging fuel vapor from the fuel vapor canister to an engine intake for a duration;

closing the canister purge valve; and determining a final resistance of the vapor blocking valve solenoid coil when the second voltage source is coupled to the vapor blocking valve solenoid coil upon completion of the purge event.

14. The method of claim 13, further comprising:

prior to opening the canister purge valve, closing the vapor blocking valve;

following closing the canister purge valve, opening the vapor blocking valve; and following determining a final resistance of the vapor blocking valve solenoid coil, closing the vapor blocking valve.

15. The method of claim 9, wherein adjusting a fuel vapor canister purge schedule comprises increasing a commanded purge air flow summation following the refueling event.

16. A method for an evaporative emissions system, comprising:

indicating degradation of a fuel vapor canister based on a change in resistance of a vapor blocking valve solenoid coil while the a solenoid valve is in an open position during a purge event; and adjusting an evaporative emissions test schedule based on a resistance of a vapor control valve solenoid coil mounted in a central cavity of the fuel vapor canister.

17. The method of claim 16, further comprising:

determining an expected change in resistance of the vapor blocking valve solenoid coil during a purge event;

indicating an observed change in resistance of the vapor blocking valve solenoid coil over a duration of the purge event; and indicating fuel vapor canister desorption degradation responsive to the observed change in resistance being less than the expected change in resistance.

18. The method of claim 16, further comprising:

indicating degradation of the fuel vapor canister based on a resistance of a vapor blocking valve solenoid coil during a refueling event.

19. The method of claim 18, further comprising:

determining an expected change in resistance of the vapor blocking valve solenoid coil during a refueling event;

indicating an observed change in resistance of the vapor blocking valve solenoid coil over a duration of the refueling event; and indicating fuel vapor canister adsorption degradation responsive to the observed change in resistance being less than the expected change in resistance.

20. The method of claim 16, wherein adjusting an evaporative emissions test schedule comprises updating leak test parameters based on a working capacity of the fuel vapor canister, the working capacity based on the resistance of a vapor control valve solenoid coil.

* * * * *